US005171315A

United States Patent [19]

Cabrero

[11] Patent Number: 5,171,315

[45] Date of Patent: Dec. 15, 1992

[54] DEPILATING APPLIANCE

[75] Inventor: Gilles Cabrero, Paris, France

[73] Assignee: Femini, Paris, France

[21] Appl. No.: 716,234

[22] Filed: Jun. 17, 1991

[30] Foreign Application Priority Data

Jun. 20, 1990 [FR] France ..... 90 07701

[51] Int. Cl.[5] ..... A61B 17/00

[52] U.S. Cl. ..... 606/131; 606/133

[58] Field of Search ..... 606/131, 133; 452/82, 452/83, 84, 85

[56] References Cited

U.S. PATENT DOCUMENTS

| | | | |
|---|---|---|---|
| 1,925,625 | 9/1933 | Budd et al. | 452/82 |
| 4,807,624 | 2/1989 | Gross et al. | 606/133 |
| 4,825,867 | 5/1989 | Gross et al. | 606/133 |
| 4,830,004 | 5/1989 | Alazet | 606/133 |
| 4,960,422 | 10/1990 | Demeester | 606/133 |
| 5,032,126 | 7/1991 | Cleyet et al. | 606/133 |
| 5,041,123 | 8/1991 | Oliveau et al. | 606/133 |

*Primary Examiner*—Peter A. Aschenbrenner
*Attorney, Agent, or Firm*—Young & Thompson

[57] ABSTRACT

The roller of a depilating appliance is made up of a series of disks placed transversely to the roller shaft. Movable gripping blades mounted between the disks are each applied periodically against an adjacent bearing disk. The gripping blades are independent of each other and are freely mounted for sliding motion in the axial direction on two pins disposed in parallel relation to and on each side of the roller shaft, the two pins being carried by two retaining cheeks which serve to drive the assembly in rotation. Each gripping blade is associated with an individual cam, guide track or the like, the profile of which has the effect of imparting an axial movement to the corresponding gripping blade during rotation of the roller and in a predetermined angular position of said roller in order to apply the blade against the adjacent bearing disk.

7 Claims, 4 Drawing Sheets

FIG. 4
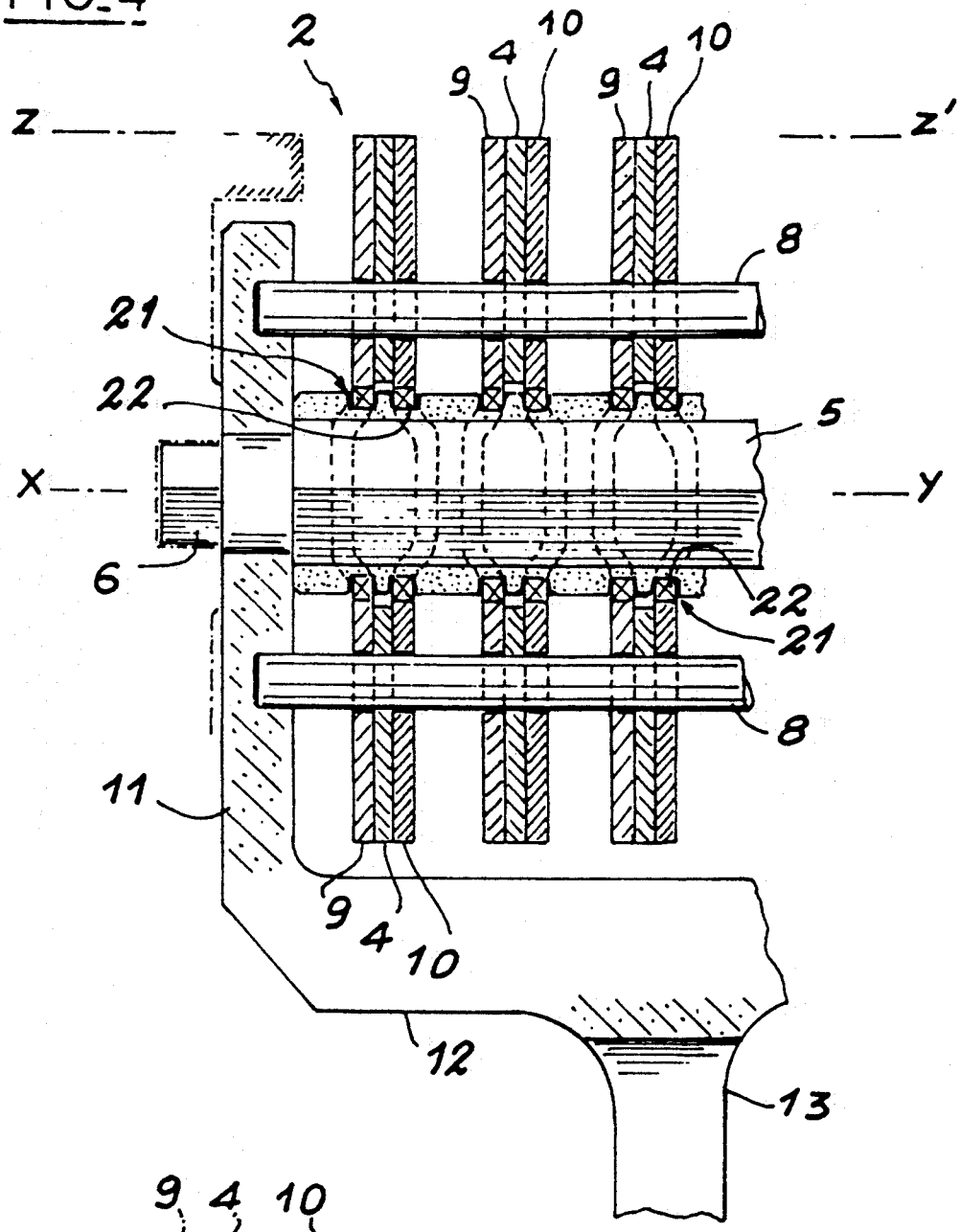
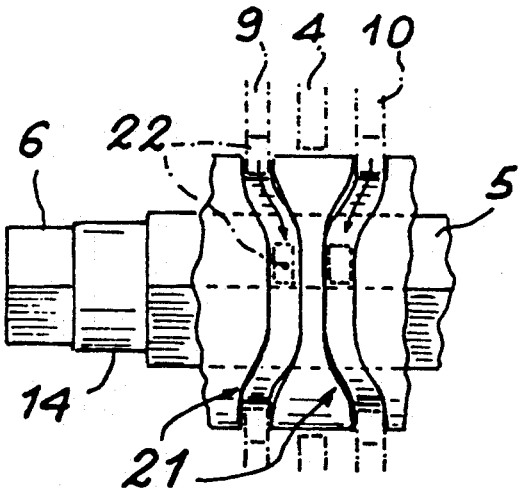
FIG. 5

DEPILATING APPLIANCE

BACKGROUND OF THE INVENTION

1. Field of the Invention

The present invention relates to a depilating appliance of the type comprising a rotary depilating roller which is intended to be displaced in contact with the skin.

2. Description of the Prior Art

More specifically, the invention is concerned with appliances in which the depilating roller is made up of a series of disks or the like which are placed transversely with respect to the roller shaft. Movable gripping blades mounted between the disks are intended to be applied periodically against the adjacent disks and to grip the hairs engaged within the roller in order to pull them out under the action of the tractive force produced by the rotation of the roller about its own axis. The efficiency of these appliances relies on the need to ensure that all the movable blades are applied and clamped against the stationary disks at the moment of gripping hairs. This accordingly calls for a very high degree of positional accuracy of the movable blades as well as the disks. Unfortunately, inevitable manufacturing tolerances hinder the achievement of this objective in the majority of instances.

This is essentially due to the fact that, in prior-art devices of the type considered, the disks are fixed on the roller shaft or are integral therewith whilst the movable blades are carried by a common support which can constitute their actuating member at the same time. In consequence, it may happen as a result of manufacturing tolerances that certain blades remain separated from the corresponding disks or that they are at least insufficiently applied against them whereas the other blades are correctly applied against the respective disks.

For this reason, the object of the present invention is to produce a depilating appliance of the same general type but so designed as to ensure that all the movable blades are efficiently applied against the corresponding bearing disks.

SUMMARY OF THE INVENTION

The depilating appliance in accordance with the invention embodies the following distinctive features:

- the gripping blades are independent of each other and are freely mounted for sliding motion in the axial direction on two pins disposed in parallel relation to the depilating roller shaft on each side of said shaft, said two pins being carried by two retaining cheeks which serve to drive the assembly in rotation,
- each gripping blade is associated with an individual cam, guide track or the like, the profile of which has the effect of imparting an axial movement to the corresponding gripping blade during rotation of the roller and in a predetermined angular position of said roller in order to apply said blade against the adjacent bearing disk.

Thus, the different gripping blades which are independent of each other are each controlled by a separate and distinct cam. This accordingly removes the disadvantages observed when the gripping blades are mounted on a common support and/or driven by a single actuating member.

In accordance with another distinctive feature of the appliance under consideration, the bearing disks themselves are mounted for sliding motion in the axial direction on the two pins which carry the movable gripping blades and provision is accordingly made for two gripping blades on each side of each disk, the operating cams or the like being capable of causing these two blades to be simultaneously applied against the disk which is placed between them.

It can thus be guaranteed that the gripping blades will be applied against the corresponding disks. Indeed, if one of these disks is not located in the precise position required at the moment of hair-gripping, the pressures exerted by the two blades on each side of the disk automatically ensure displacement of the disk to the requisite position by sliding along the two guide pins as indicated earlier. However, this sliding motion takes place with strong friction, thus preventing the bearing disks from moving accidentally while the roller is rotating.

In an advantageous embodiment of the appliance considered, the gripping blades being constituted by disks having a hollowed-out central portion, the cams or guide tracks of said blades are located at the periphery of the stationary shaft of the rotary roller and each blade is provided on the edge of its central opening with one or two lugs engaged with one of said cams or guide tracks.

BRIEF DESCRIPTION OF THE DRAWINGS

FIGS. 3 and 4 are fragmentary axial sectional views of said depilating roller along the line III—III of FIG. 2; these two figures illustrate respectively the gripping blades in the withdrawn position and in the clamping position.

FIG. 5 is a fragmentary overhead plan view of the stationary shaft of the depilating roller, two of the guide tracks provided on the shaft being shown in this view.

DETAILED DESCRIPTION OF THE INVENTION

Figure 1:
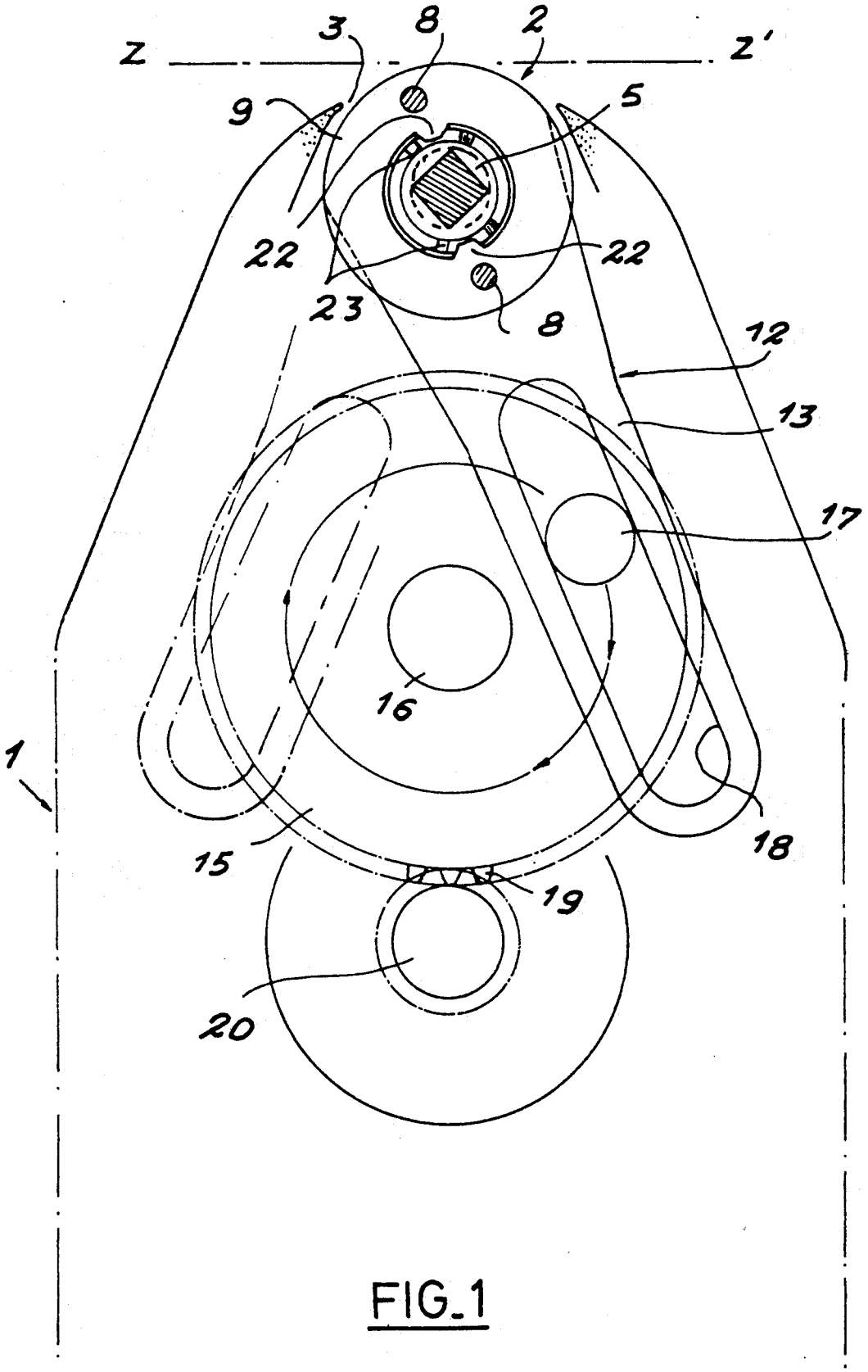
FIG. 1 is a schematic transverse sectional view of the working head of a depilating appliance in accordance with the invention.
Figure 2:
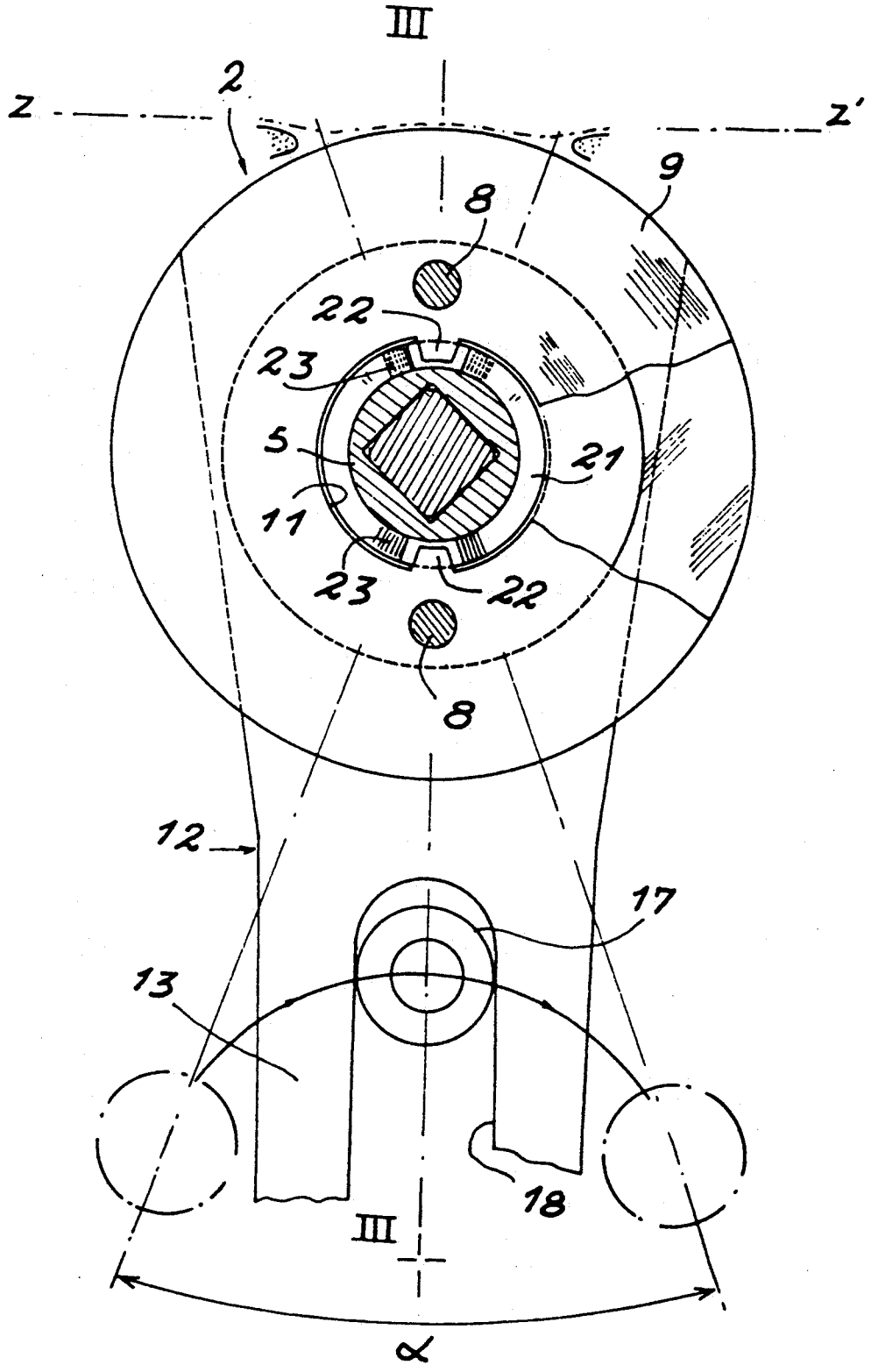
FIG. 2 is a transverse sectional view of the depilating roller.

The appliance in accordance with the invention includes a casing 1, part of which is simply shown in outline in FIG. 1. This casing contains a small electric motor (not shown) which can be battery-powered or connected to the line supply. At one end of the casing, provision is made for a working head constituted by a rotary depilating roller 2 which projects from or is mounted flush with an opening 3 of the corresponding end of the casing.

The depilating roller 2 is formed by a series of disks 4 placed transversely to the roller shaft 5 in planes located at right angles to the roller. In contrast to certain appliances of the same general type, these disks 4 are totally independent of the shaft 5 and this latter is secured against rotation, the shaft ends 6 of polygonal cross-section being fitted within recesses having the same cross-section and provided in the walls of the casing 1. Each disk 4 has a central opening 7 which has a larger cross-section than the stationary shaft 5. All the disks 4 are threaded on two pins 8 disposed in parallel relation to and on each side of the shaft 5. The disks 4 are mounted on these two pins so as to be capable of sliding with strong friction, with the result that these disks normally remain in a stationary position but may nevertheless be displaced by sliding under the action of a predetermined pressure.

On each side of each disk 4, provision is made for two movable blades 9 and 10 which are intended to be applied against the disk located between them, this being achieved by movements of translation carried out in opposite directions. As in the case of the bearing disks 4, the blades 9 and 10 are each provided with a central opening 9*a* through which is engaged the stationary shaft 5 of the roller. The blades are also threaded on the two pins 8 already mentioned but are mounted for free sliding motion on these two pins and not with strong friction as is the case with the bearing disks 4.

The roller assembly formed by the bearing disks 4 and the blades 9 and 10 is intended to be driven in rotation by the two pins 8 about the central shaft 5 which remains stationary. In the example shown, the movement of rotation considered is not continuous in a predetermined direction but alternating in one direction and in the other through an angle of displacement which may be 30°, for example. To this end, the two pins 8 are fixed at the ends thereof in retaining cheeks 11 of a stirrup-shaped oscillating member 12. The cheeks 11 of said member are mounted so as to be freely rotatable about a cylindrical bearing 14 provided at each end of the stationary shaft 5. Thus, the member is capable of oscillating freely about the axis X-Y of said shaft.

The oscillating member 12 is adapted to carry an arm 13 coupled with a disk-crank 15 which carries an eccentric stud 17 engaged in a slider 18 provided in the arm 13 of the oscillating member 12. Thus the continuous rotation of the disk-crank 15 ensures the requisite movement of oscillation of the member 12 and consequently of the depilating roller. The disk-crank 15 can be driven in rotation by means of a toothed ring 19 disposed in mesh with a pinion coupled with the output shaft of the motor provided in the appliance.

On the edge of their central opening 9*a*, the movable gripping blades 9 are each provided with two projecting lugs 22 which are engaged in a guide track 21 forming a cam and provided at the periphery of the stationary shaft 5. The shaft therefore has a series of guide tracks 21, each track being assigned to a predetermined movable blade 9 or 10.

Figure 3:
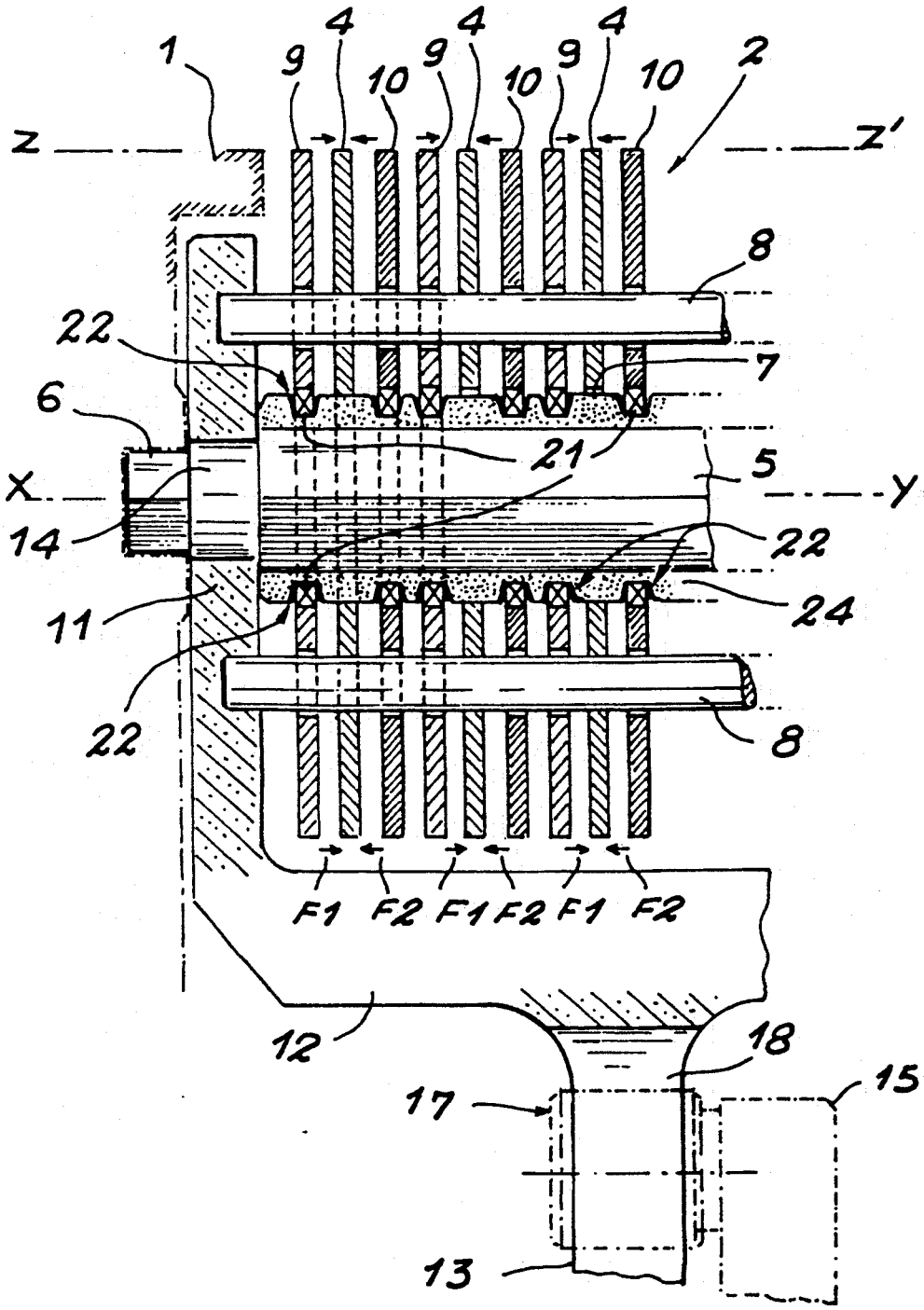

The profile of these guide tracks is such that, in a predetermined angular position of the depilating roller, said tracks produce an axial displacement of the gripping blades 9 and 10 by sliding along the pins 8 so as to apply against each bearing disk 4 the two blades 9 and 10 which are located on each side. To this end, the guide tracks 21 of each category of movable blades 9 and 10 have portions 23 which are elbowed in opposite directions towards the intermediate bearing disk 4. Thus, there exists on each guide track 21 two elbowed portions oriented in the same direction but located in diametrically opposite positions since each movable blade has two lugs 22 which are themselves located in diametrically opposite positions. In the example illustrated, these elbowed portions 23 are located along the line III—III which is the median line of the angle of oscillation of the depilating roller. Thus, the gripping blades are clamped against the bearing disks each time the roller reaches the mid-point of its travel in one direction or in the other. On each side of this clamping position, the gripping blades 9 and 10 are withdrawn from the bearing disks 4 as shown in FIG. 3. Under these conditions, the hairs of the skin can then engage between the bearing disks and the gripping blades.

When the depilating roller 2 reaches the median gripping position, the elbowed portions 23 of the guide tracks 21 cause displacement of the lugs 22 towards the corresponding intermediate bearing disk 4. This produces an axial sliding movement of the blades 9 and 10 in opposite directions as indicated by the arrows F1 and F2 in FIG. 3. In consequence, the blades 9 and 10 located on each side of any one bearing disk 4 are thus applied against said disk as shown in FIG. 4.

Effective application of each movable blade 9 or 10 against the corresponding bearing disk 4 is then ensured since these blades are independent of each other and the displacement of each blade is controlled by a separate cam constituted by the respective guide track 21. Moreover, in the event that one of the bearing disks 4 is not correctly placed during the gripping operation of the movable blades 9 and 10, the pressure exerted by the corresponding blades against said disk would automatically replace the disk in the correct position. This is made possible by the fact that each bearing disk 4 is capable of displacement along the pins 8 in frictional sliding motion.

The guide tracks 21 can be formed directly on the periphery of the stationary shaft 5, for example by fabricating the shaft from molded material. However, these guide tracks can also be formed in a sleeve 24 which is fitted on the shaft 5 as is the case in the example illustrated (in particular in FIGS. 3 and 4).

In the embodiment described in the foregoing, the arrangement is such that the depilating roller 2 is driven in an alternating movement of rotation in one direction and in the other. However, it would also be possible to provide a continuous movement of rotation of the roller 2 about its own axis. In such a case, the actuating arm 13 of the member 12 would be dispensed with and one of the retaining cheeks 11 of this member would accordingly be rigidly fixed to a toothed wheel coupled with the output shaft of the motor by means of transmission gears. Moreover, the guide tracks 21 could in this case have a profile such that the clamping action of the movable blades 9 and 10 takes place once or twice per revolution of the roller 2. But the operation of the appliance would remain the same as in the embodiment described earlier.

Instead of being disposed on the periphery of the central shaft 5, the guide tracks 21 could be provided at the periphery of the rotary roller. In such a case, these guide tracks could extend completely around the roller with an interruption at the location corresponding to the work zone Z-Z' in which the hairs to be plucked-out are gripped. Moreover, these guide tracks could be replaced by any other system of cams designed to produce an axial translational movement of the movable blades 9 and 10.

Instead of having two movable gripping blades placed on each side of any one intermediate bearing disk, the depilating roller could have only one movable blade between two bearing disks, the guide tracks 21 being such that this blade is applied against one of the two disks or else alternately against one disk and against the other. Many other arrangements may in any case be contemplated.

It is worthy of note that the term "disk" which is used to designate the bearing members 4 of the depilating roller does not mean that these members must necessarily have the shape of a circular disk with a continuous contour. The external contour of these parts can in fact be different. Similarly, the movable gripping blades 9 and 10 can have a contour which is different from that considered in the example shown in the drawings.

In an advantageous alternative embodiment, the guide tracks 21 have a linear portion at the point of maximum proximity between the gripping blades 9, 10 and the bearing disk 4. The linear portion serves to maintain the clamping action between the gripping blades and the bearing disk for a predetermined period of time. This distinctive feature makes it possible to ensure that the hairs remain gripped by the blades and the disk during the time required to ensure that they are effectively plucked-out.

In another alternative embodiment which is also advantageous, the nominal groups of gripping blades 9, 10, of bearing disks 4 and corresponding guide tracks 21 are placed around the shaft 5 of the depilating roller 2 with a predetermined relative angular displacement. The advantages of this arrangement lie in the fact that it ensures a displacement in time between gripping of hairs in a given zone. This very appreciably reduces or even eliminates plucking of hair in tufts and consequently reduces pain or discomfort experienced by the user. Moreover, this arrangement reduces power consumption and eliminates consumption peaks caused by plucking-out of tufts by appliances in which no provision is made for any relative angular displacement between their nominal groups.

As will be readily understood, the angular value of the linear portion of the guide tracks 21 and also of the relative displacement between the nominal groups will be a function of the diameter of the shaft 5 and of the number of nominal groups.

What is claimed is:

1. A depilating appliance comprising a roller assembly carried by a support member and including a rotary depilating roller made up of a series of disks between which are mounted movable gripping blades, said disks being placed transversely with respect to a central roller shaft, each blade adapted to be applied periodically against an adjacent bearing disk, wherein:

the gripping blades are independent of each other and are freely mounted for sliding motion in the axial direction on two pins disposed in parallel relation to the roller shaft on each side of said shaft, said two pins being carried by two retaining cheeks of said support member, each gripping blade including means for engaging an individual guide track forming a cam and provided at the periphery of said roller shaft, each of said guide track having a profile such that in a predetermined angular position of said roller, each track produces an axial movement to the corresponding gripping blade during rotation of the roller in order to apply said blade against the adjacent bearing disk.

2. A depilating appliance according to claim 1, wherein the bearing disks are independent of the central shaft which is stationary and said disks are slidably and frictionally mounted on the pins which carry the movable gripping blades.

3. A depilating appliance according to claim 2, wherein two movable gripping blades are provided on each side of each bearing disk and the two guide tracks engaging both of said blades have a profile such that, in a predetermined angular position of the roller, they produce displacements of these two blades in opposite directions in order to apply them on each side of the corresponding bearing disk.

4. A depilating appliance according to claim 1, wherein each blade is provided with a central opening, and the means for engaging the guide tracks provided on the periphery of the central shaft consist of one or a number of lugs designed to project from the edge of the opening of each movable blade.

5. A depilating appliance according to claim 1, wherein the depilating roller includes means for driving it in an alternating movement of partial rotation in one direction and in the other, and the operating cams have a profile such that they cause the movable gripping blades to be applied against the bearing disks when the roller is located at the mid-point of its travel in one direction and in the other.

6. A depilating appliance according to claim 1, wherein each guide track has a linear portion at the point of maximum proximity between the gripping blades and the bearing disk in order to increase the time of application of the gripping blades against each bearing disk.

7. A depilating appliance according to claim 1, wherein the bearing disks and gripping blades as well as the corresponding guide tracks are placed around the shaft of the depilating roller with a predetermined relative angular displacement.

* * * * *